US008256791B2

(12) United States Patent
Gerndt et al.

(10) Patent No.: US 8,256,791 B2
(45) Date of Patent: Sep. 4, 2012

(54) GLIDING BOARD WITH IMPROVED RESPONSE TO RIDER INPUT

(75) Inventors: John W. Gerndt, Moscow, VT (US); Peter J. Bergendahl, South Burlington, VT (US); Christopher Fidler, Burlington, VT (US); Brendan Murphey, San Clemente, CA (US); Scott Seward, South Burlington, VT (US); Todd King, South Burlington, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 12/986,741

(22) Filed: Jan. 7, 2011

(65) Prior Publication Data

US 2012/0119470 A1 May 17, 2012

Related U.S. Application Data

(60) Provisional application No. 61/414,340, filed on Nov. 16, 2010.

(51) Int. Cl.
*A63C 5/04* (2006.01)

(52) U.S. Cl. ..... 280/608; 280/609; 280/607

(58) Field of Classification Search ..... 280/601, 280/611, 608, 607, 609, 14.21, 14.22, 602, 280/603
See application file for complete search history.

(56) References Cited

U.S. PATENT DOCUMENTS

| | | | | |
|---|---|---|---|---|
| 4,377,297 | A | 3/1983 | Staufer | |
| 4,951,960 | A | 8/1990 | Sadler | |
| 5,687,983 | A * | 11/1997 | Feketa et al. | 280/609 |
| 5,782,475 | A | 7/1998 | Balmain | |
| 6,499,758 | B1 | 12/2002 | Fournier | |
| 6,736,689 | B2 * | 5/2004 | Renard et al. | 441/65 |
| 6,945,563 | B2 | 9/2005 | Clausing | |
| 7,089,875 | B2 * | 8/2006 | Kurze | 114/55.56 |
| 7,219,916 | B2 * | 5/2007 | Olson | 280/609 |
| 7,275,755 | B2 * | 10/2007 | Marion | 280/602 |
| 2001/0012553 | A1 * | 8/2001 | Marion | 428/99 |
| 2004/0084878 | A1 | 5/2004 | Adamczewski | |

(Continued)

FOREIGN PATENT DOCUMENTS

| | | |
|---|---|---|
| AT | 173373 | 12/1952 |

(Continued)

OTHER PUBLICATIONS

Extended European Search Report and the Written Opinion of the European Searching Authority for European Application No. EP 11 18 9158.6, Dated Mar. 20, 2012.

(Continued)

*Primary Examiner* — Hau Phan
(74) *Attorney, Agent, or Firm* — Wolf, Greenfield & Sacks, P.C.

(57) ABSTRACT

A gliding board with an effective edge length to waist width ratio of 3.8 to about 4.35, a waist width of at least about 250 mm, a core that has an approximately constant thickness of greater than 5 mm along substantially the entire running length of the board and to within about 80-100 mm of the effective edge points, but thins to a thickness of about 2 mm or less in areas nearer the effective edge points, and/or side edges that include a curved, concave sidecut portion at the waist, curved, convex transition zones at the forward and rear effective edge points and a straight section in the running length adjacent each transition zone.

71 Claims, 1 Drawing Sheet

U.S. PATENT DOCUMENTS

| | | | | |
|---|---|---|---|---|
| 2004/0135347 | A1* | 7/2004 | Marion | 280/610 |
| 2004/0198112 | A1* | 10/2004 | Renard et al. | 441/65 |
| 2006/0267298 | A1 | 11/2006 | Repa | |
| 2007/0170694 | A1 | 7/2007 | Adamczewski et al. | |
| 2008/0116662 | A1 | 5/2008 | Bourgier et al. | |
| 2009/0273161 | A1 | 11/2009 | Kessler | |

FOREIGN PATENT DOCUMENTS

| | | | |
|---|---|---|---|
| DE | 102005015144 | A1 | 11/2005 |
| EP | 1864696 | A1 | 12/2007 |
| EP | 1935459 | A1 | 6/2008 |
| FR | 2786108 | A1 | 5/2000 |
| FR | 2893511 | A1 | 5/2007 |
| WO | WO 2006/092020 | A1 | 9/2006 |
| WO | WO 2007/099325 | A2 | 9/2007 |

OTHER PUBLICATIONS

Selected pages of "Supermarket—a Supplement to TransWorld SNOWBoarding Magazine" identifying details for the Morrow Lunch Tray 29 board, cover page & p. 351, 1994.

* cited by examiner

GLIDING BOARD WITH IMPROVED RESPONSE TO RIDER INPUT

This application claims the benefit of U.S. Provisional application 61/414,340, filed Nov. 16, 2010.

BACKGROUND

This invention relates to a gliding board, such as a snowboard, wakeboard, or other similar device for gliding on a surface.

Snowboards that are designed for use by adults and that have a relatively short overall length are known, for example from U.S. Patent Publication 2006/0267298 and U.S. Pat. No. 4,951,960. Moreover, snowboards having a relatively low effective edge length to waist width ratio were offered for sale at least as early as 1995, such as the Morrow Lunch Tray 29, which has an effective edge length to waist ratio of about 4.05 (using lengths in centimeters) and a waist width of about 25.6 cm. In addition, snowboards having areas with different bending characteristics along the length of the board are generally known, e.g., from U.S. Pat. No. 6,499,758; U.S. Patent Publication 2004/0084878 and U.S. Patent Publication 2007/0170694. These board designs tend to stiffen the board in areas under the rider's feet as compared to adjacent areas fore and aft of the binding mounting region. For example, as can be seen in FIGS. 1 and 4 of U.S. Patent Publication 2004/0084878 and FIGS. 1 and 4 of U.S. Patent Publication 2007/0170694, the thickness of the board is greater in the binding mounting regions (reference numbers 10 and 12 for U.S. Patent Publication 2004/0084878, and reference numbers 16 and 18 U.S. Patent Publication 2007/0170694). Similarly, U.S. Pat. No. 6,499,758 has increased structural strength in the board at areas under the rider's feet. See col. 5, lines 51-57 and FIGS. 1 and 16, for example.

SUMMARY OF INVENTION

In accordance with at least some embodiments of the invention, the inventors have unexpectedly discovered that particular board thickness arrangements in relation to the board's effective edge points, effective edge length to waist width ratios used with a rocker configuration, and board edge configurations provide a substantial improvement in board handling and responsiveness to rider input. In addition, combinations of these features have been found to provide a board that responds to rider actions in a way that prior boards were simply incapable of. For example, one embodiment has a board with an effective edge length to waist width ratio of 3.8 to about 4.35, and a core that has an approximately constant thickness of greater than 5 mm along substantially the entire running length of the board (i.e., between the effective edge points). However, within about 80-100 mm of the effective edge points, the core abruptly thins such that the core has a thickness of about 2 mm or less within about 30 mm of the effective edge points. When combined with a rocker configuration, this board has been surprisingly found to allow riders to perform ollies and similar maneuvers significantly faster than prior boards, allowing the rider to approach much closer to objects before "ollying" onto or over them. This is a significant advantage, e.g., as it allows riders to perform various maneuvers with respect to relatively closely spaced objects since the longer approach distance needed with other boards is not required.

In one aspect of the invention, a gliding board, such as a snowboard, includes an upturned nose at a forward end of the board, a tail at a rear end of the board, a running length connected to and located between the nose and tail, a top surface of the board extending from the nose to the tail over a top portion of the running length, and a bottom surface of the board extending from the nose to the tail over a lower portion of the running length. At least a portion of the bottom surface may be constructed and arranged to contact a gliding surface during riding, e.g., include a suitable polymer base material found in skis and snowboards. Side edges on opposite sides of the running length may extend between the nose and the tail and define forward effective edge points, a waist width and rear effective edge points for the board. The waist width is the narrowest part of the board between the effective edge points. Effective edge points are the outermost points of the board (i.e., points nearest the extreme ends of the nose and tail) that contact a flat, horizontal surface when the board is turned on one edge with the top and bottom surfaces oriented generally perpendicularly to the flat, horizontal surface. The board has an effective edge length that is a distance from a forward effective edge point on one side of the board to a rear effective edge point on the same side of the board.

The board may also include forward and rear binding mounting features each arranged to engage with and secure a foot binding to the board top surface. The binding mounting features may include, for example, a pattern of threaded inserts, a channel or other arrangement suitable to attach a binding to the board. The forward and rear binding mounting features may each define a respective forward and rear binding mounting region in the running length in which a respective foot binding is securable to the board, with the forward binding mounting feature being located nearer the nose than the rear binding mounting feature. The forward binding mounting feature may have a forward reference stance position nearest the nose and the rear binding mounting feature may have a rear reference stance position nearest the tail. The reference stance positions are those locations where an average rider would mount the forward and rear bindings on the board, though many riders may mount their bindings forward or rearward of the reference stance positions. The reference stance positions are generally marked on a board to provide the rider with a reference point from which to determine binding location relative to the board's longitudinal center. For those boards that are not marked with a forward or rear reference stance position, the reference stance positions are located approximately 450-585 mm apart and are centered about the board's longitudinal center, i.e., the forward reference stance position will be 225-275 mm forward of the board's longitudinal center, and the rear reference stance position will be 225-275 mm rearward of the board's longitudinal center.

In one embodiment, the board has an effective edge length to waist width ratio of about 3.8 to about 4.35, the waist width is at least about 250 mm or greater, the running length has a rocker configuration such that the effective edge points are uplifted from a horizontal surface when the board is resting on a flat, horizontal surface, and a distance between the forward reference stance position and a forward transition line extending between the forward effective edge points or a distance between the rear reference stance position and a rear transition line extending between the rear effective edge points is between about 150 and about 350 mm. By having a waist width of at least about 250 mm or more, the board can be constructed for use by an adult, i.e., a person that has a larger overall size and weight than a child. Also, the effective edge length to waist width ratio of 3.8 to 4.35 combined with a rocker configuration has been found to be particularly advantageous in providing a board that is highly responsive and easy for a rider to maneuver while having the stability and power found in longer, conventional boards having a standard camber.

One significant difference between this embodiment and other boards that are described to have a relatively short overall length, such as that in U.S. Patent Publication 2006/0267298, U.S. Pat. No. 4,951,960 and the Morrow Lunch Tray 29 (as just a few examples) is that the board has a defined effective edge length to waist width ratio combined with a rocker configuration. In contrast U.S. Patent Publication 2006/0267298 and U.S. Pat. No. 4,951,960 describe overall length to waist width ratios, not effective edge length to waist width ratios. That is, the overall length of a board includes nose and tail lengths, and does not necessarily provide meaningful information regarding that part of the board influences the board's response on a flat and relatively hard packed surface. For example, most snowboards include an upturned nose and tail that do not contact the snow when riding on a flat slope. As a result, the nose and tail have little or no affect on the board's performance in such conditions. Thus, a teaching to construct a board to have a particular overall length to waist width ratio does not necessarily indicate anything regarding what the effective edge length relative to the waist width should be for the board.

With respect to the Lunch Tray and similarly configured boards, these boards had a conventional, standard camber, not a rocker configuration. In contrast, the effective edge length to waist width ratio of 3.8 to 4.35 combined with a rocker configuration has been surprisingly found to provide a highly maneuverable and responsive board that also exhibits the stability and power (e.g., ability to store and return energy input by a rider, such as during turns and/or jumps) of a longer, standard camber board. A rocker configuration may take a variety of forms, but all arrangements share the feature that the effective edge points are uplifted when the board rests unweighted on a flat, horizontal surface and/or the running length has an overall convex configuration. For example, a rocker configuration may be arranged with a continuous convex (down) curve along the entire running length, a convex center section (rocker section) flanked by concave sections (standard camber sections) in the running length, a convex center section (rocker) flanked by flat sections in the running length, a flat center section flanked by convex sections, and so on.

In another embodiment, the side edges on opposite sides of the running length may each include a curved, concave sidecut portion at the waist, curved, convex transition zones at the forward and rear effective edge points and a straight section in the running length adjacent each transition zone. Each of the straight sections may extend between an inner end where the straight section meets a respective curved sidecut portion and an outer end where the straight section meets a respective transition zone. The straight sections may be tangent to the respective sidecut portion at the inner end and tangent to the respective transition zone at the outer end. This arrangement is in contrast to other board side edge configuration, such as that in DE 102005015144 or FR 2893511, which both include straight segments in the running length, but the straight segments are not tangent to curved edge portions at either end of the straight segment. The inventors have found that straight sections arranged to be tangent as described above provide unexpected advantages in snowboard handling, e.g., when initiating a turn and/or riding flat. The straight sections provide good, positive edge grip in turns while the tangent configuration at both ends of the straight sections allow for a more gradual engagement of the straight section with the snow or other gliding surface than would otherwise be possible.

In some embodiments, the straight sections may be relatively close to the effective edge points. For example, the transition zones may be located at each effective edge point of the board, e.g., the transition zones may be centered about a respective effective edge point. The straight sections, which each join a respective transition zone, may be located within about 20-100 mm of a nearest effective edge point, and may have a length of about 20-150 mm. In one illustrative embodiment, the transition zones may have a length of about 105 mm, and the straight sections may have a length of about 35 mm. Also, the straight sections may form a relatively small angle with respect to a longitudinal axis of the board, e.g., the straight sections may be nearly parallel to the longitudinal axis, i.e., form an angle of up to a few degrees relative to the longitudinal axis.

In yet another embodiment, the board may have a core with a thickness that is greater than about 5 mm within about 100 mm of a forward transition line extending between the forward effective edge points and/or a thickness that is greater than about 5 mm within about 100 mm of a rear transition line extending between the rear effective edge points. This is in contrast to prior snowboards, in which the core thins to less than 5 mm at larger distances from the transition lines, e.g., the core has a thickness of less than 5 mm within about 150 mm or more of the transition lines. By carrying a relatively thick core section nearer the effective edge points, the board may be made more responsive to rider input. In regions relatively close to the forward or rear transition lines, e.g., within about 0-80 mm of the transition lines in the running length, the core may have a thickness of less than 5 mm, e.g., within about 30 mm of the forward or rear transition line, the core may have a thickness of about 2 mm or less. In one embodiment, the core may have a thickness that is greater than 5 mm within about 85 mm of the forward and rear transition lines, and may have a thickness that reduces to about 2 mm or less at the transition lines.

In another embodiment, the core may have a thickness that begins to reduce from greater than about 5 mm at the inner ends of straight segments of the side edges. The straight segments may be arranged as described above, e.g., located adjacent transition zones that include the forward and/or rear effective edge points. The thickness of the core may be reduced to less than about 2 mm near or at the forward or rear transition lines. This type of arrangement in which the board's core thins significantly from greater than 5 mm to about 2 mm or less in an area of the board flanked by straight sections at the side edges has been found to provide significant advantages in board handling. For example, by reducing the board's overall thickness in the areas where the straight sections of the side edges are located, the board may be made more flexible in the local area at the extreme ends of the running length where the straight sections engage the snow or other surface when a turn is initiated. This may make the board more forgiving at turn initiation, e.g., reduce the likelihood of the straight sections catching the snow or otherwise establishing a more effective engagement with the gliding surface than is desired. This feature may be advantageous in a snowboard, in part because straight sections of an edge may tend to engage snow more aggressively and/or abruptly than a curved section would. As a result, the core may be made relatively thick over a substantial portion of the running length to make the board more responsive to rider input, but also be thinned near the forward and/or rear transition lines and straight sections at the edges to make the board perform better, and more predictably, when initiating turns or running flat.

In one embodiment, the thickness variations of a board may be achieved by adjusting the thickness of a core of the board (e.g., the thickness of the core, which may be made of wood, foam or other, may be made less in the binding mounting regions than at other areas adjacent the binding mounting regions). This arrangement of the core thickness may be useful for boards that are made with a so-called sidewall construction, where the board side edges include a sidewall element positioned between top and bottom reinforcement layers and at least partially exposed along the board's edge. In another embodiment, the board may have a cap construction at the nose, tail and running length and the thickness of the board may be defined, at least in part, by the spacing between mold elements used to form the board during a molding process. In such cases, the mold may itself define the thickness of the board's core by defining the outer limits of the top and bottom surfaces of the board.

These and other aspects of the invention will be understood from the following description and claims.

BRIEF DESCRIPTION OF THE DRAWINGS

Illustrative embodiments that incorporate one or more features according to the invention are described with reference to the following drawings.

DETAILED DESCRIPTION

Figure 1:
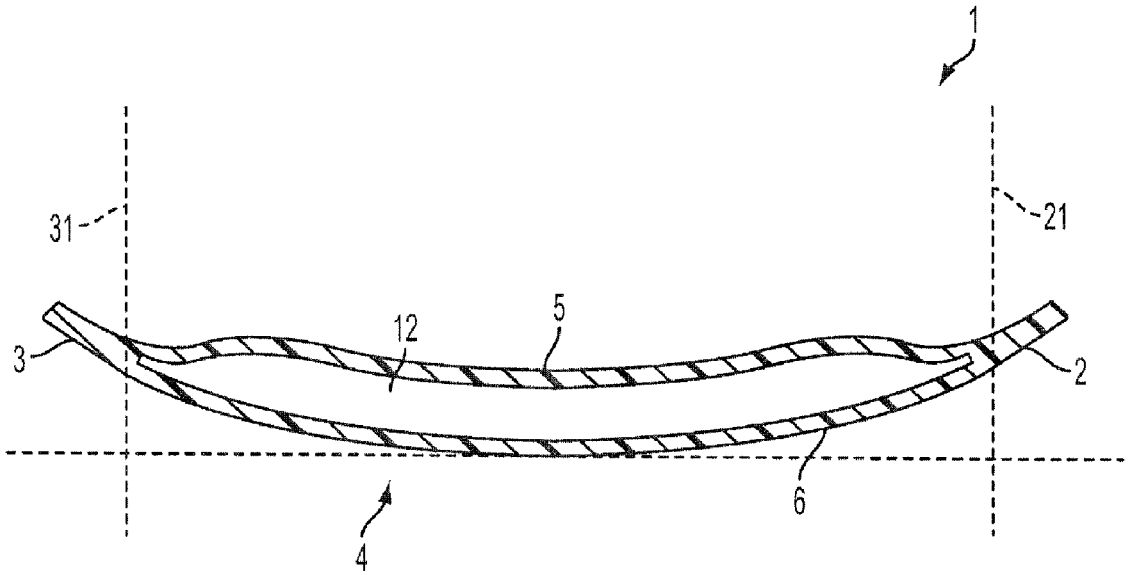
FIG. 1 shows a side view of an embodiment of a board in an illustrative embodiment.
Figure 2:
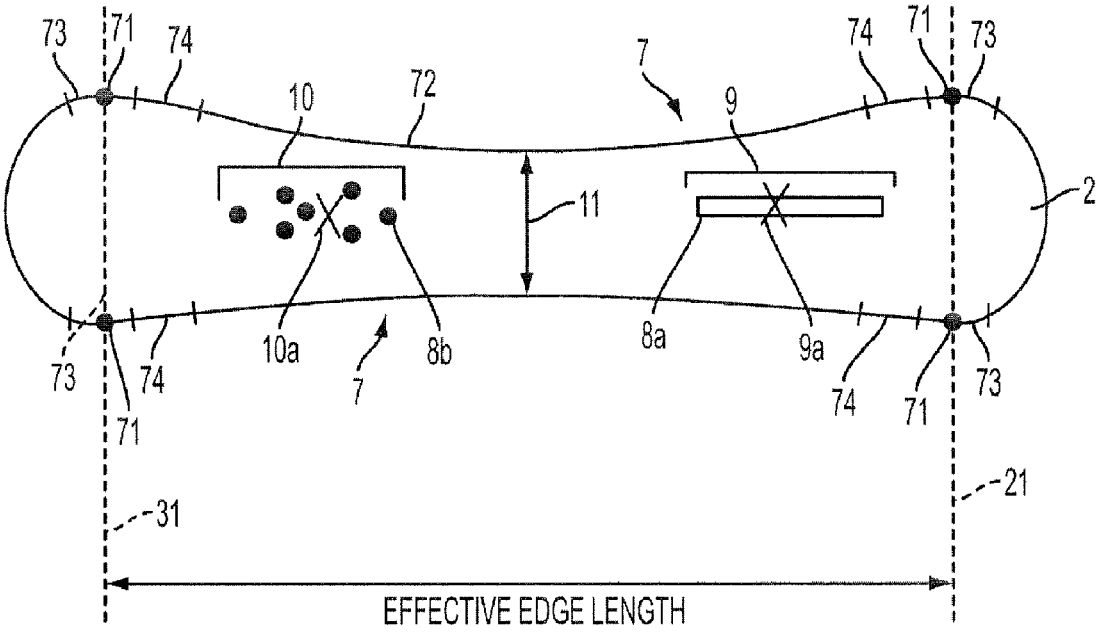
FIG. 2 shows a top view of the FIG. 1 embodiment.

FIGS. 1 and 2 show an illustrative embodiment of a board that incorporates one or more aspects of the invention. In this embodiment, the board 1 is a snowboard, but one or more aspects of the invention can be employed with boards of other types, such as skateboards, wakeboards, etc. The board 1 includes an upturned nose 2 at a forward end of the board, and a tail 3 at a rear end of the board. The tail 3 in this embodiment is upturned similarly to the nose 2, but it should be understood that the tail 3 need not necessarily turn upwardly to the same extent as the nose 2 and may be substantially straight. The nose 2 and tail 3 are located at opposite ends of a running length 4 of the board, which is generally located between transitions to the nose 2 and tail 3, as is understood in the art. The board 1 has a top surface 5 extending from the nose 2 to the tail 3 over a top portion of the running length 4, and a bottom surface 6 extending from the nose 2 to the tail 3 over a lower portion of the running length 4. The top surface 5 may be arranged in any suitable way, e.g., as a top sheet or laminate of sheets including a polymer film with suitable graphics and so on. The bottom surface 6 may be constructed and arranged to contact a gliding surface during riding, e.g., may include a sheet of polymer material such as a high density polyethylene or other material suitable for gliding on a snow, ice or other similar surface.

Side edges 7 on opposite sides of the running length 4 extend between the nose 2 and the tail 3, and may have any suitable sidecut arrangement. For example, the side edges 7 may be arranged to have a single, relatively large radius of curvature, or may include two or more sections that have different radii of curvature and/or are that are straight, as discussed in more detail below. If straight sections are included in the side edges 7, the straight sections may be parallel to a longitudinal axis and/or arranged at transverse angles to the longitudinal axis. Although in this example the side edges 7 are shown to cause the board to be generally narrower near the center of the running length 4 (e.g., at a waist 11) than at the transition lines 21, 31 to the nose 2 and tail 3, other arrangements are possible, such as having the width of the board at the waist 11 being larger than the width at one or more transitions 21, 31 to the nose or tail. Alternately, the side edges 7 may be arranged generally as shown in FIG. 1, but have a bulge near the waist 11 such that the board width increases at the longitudinal center of the board as compared to portions forward and rearward of the longitudinal center (and the edges 7 are convex rather than concave at the bulge), but the width at the longitudinal center of the board 1 remains smaller than the width at the transitions 21, 31. The side edges 7 may include metal edges, e.g., at the lower portion of the edges near the bottom surface 6, that are arranged to engage with snow or ice and help maintain the board's position while turning on such surfaces.

The board 1 may also include forward and rear binding mounting features 8 that are each arranged to engage with and secure a foot binding (not shown) to the board top surface 5, as is known in the snowboard art. The binding mounting features 8 may be arranged in any suitable way, such as in the form of a channel shown at the forward binding mounting region 8*a* in FIG. 2, or a pattern of threaded inserts shown at the rear binding mounting region 8*b* in FIG. 2. If arranged as a pattern of threaded inserts, any suitable pattern may be used, such as the Burton 3D(R) pattern, a 4×4 pattern or others. Channel-type binding mounting arrangements and threaded insert patterns are known, for example, on snowboards currently sold by The Burton Corporation, and thus no further description is provided herein. However, the binding mounting features 8 are not limited to channel or insert arrangements as other binding mounting features are known in the art. In short, any suitable arrangement for mounting a snowboard foot binding (whether tray-type, step-in or other) may be used.

The forward and rear binding mounting features 8 each define a respective forward and rear binding mounting region 9, 10 in the running length 4 in which a respective foot binding is securable to the board. In this embodiment, each of the binding mounting features 8 provide a range of possible mounting positions for the binding, e.g., spanning over approximately 250-300 millimeters along the longitudinal axis of the board. That is, by using the binding mounting features 8, a binding may be mounted at one of a plurality of different, longitudinal positions on the board. (A longitudinal axis of the board extends generally from the nose 2 to the tail 3 near an approximate center of the board 1 as viewed from the top in FIG. 2). However, the binding mounting features 8 may provide a single mounting position for the binding within a region 9, 10, or an infinite number (as in the case of some channel-type mounting arrangements). Also, although the binding mounting features 8 are shown in FIG. 2 as being physically separated by a relatively large distance, the mounting features 8 may be located close together near inner ends of the mounting regions 9, 10, and may in some embodiments essentially blend together so that the mounting regions 9, 10 are immediately adjacent each other.

Each binding mounting region 9, 10 may include a respective reference stance location 9*a*, 10*a*, e.g., identified by a physical marking on the top surface 5, that indicates a location where an average rider would typically mount a foot binding to the board. Generally, the forward and rear reference stance locations 9*a*, 10*a* are spaced about 450-585 mm apart and are centered about a longitudinal center of the board, e.g., if the board has an overall length of about 1200 mm, the longitudinal center of the board is located 600 mm from either end of the board and the forward and rear reference stance locations 9*a*, 10*a* are located about 225 mm-275 mm forward and rearward, respectively, of the longitudinal center. Some boards, such as those intended for riding in soft snow or powder, have the forward and rear reference stance locations 9*a*, 10*a* shifted toward the rear of the board 1, e.g., the reference stance locations are not centered about the longitudinal center of the board, but instead are both shifted rearwardly about 20-50 mm or more. In some cases, boards are not provided with a physical marking or other indication of the reference stance locations 9*a*, 10*a*, and for those boards, the reference stance positions are located approximately 450-585 mm apart and are centered about the board's longitudinal center regardless of the absence of any indication.

In accordance with one aspect of the invention, the board has an effective edge length to waist width ratio of 3.8 to about 4.35, a waist width of at least about 245 mm to 250 mm or greater, and a rocker configuration in the running length 4. This arrangement provides a board that is configured for adult use and has a relatively short effective edge length. The effective edge length to waist width ratio of 3.8 to 4.35 in an adult configured board, combined rocker in the running length, has been found to provide significant advantages in board handling, including "pop" (the response of the board to bending input provided by the rider to the board) and quickness in turning. However, even though the board may be significantly shorter than conventional snowboards, the board has been found to have good stability at speed and in turns, a common deficiency in many relatively short boards.

The effective edge length is defined as the distance between forward and rear effective edge points on one side of the board, e.g., as shown in FIG. 2. The effective edge points 71 are located at those outermost portions of the side edges 7 that contact a flat surface when the board is turned on one edge 7 with the top and bottom surfaces 5, 6 oriented generally perpendicularly to the flat surface. The forward transition line 21 is a line that passes through the forward effective edge points 71, and the rear transition line 31 is a line that passes through the rear effective edge points 71.

The effective edge length of a board is a fundamentally different characteristic than the overall length of the board. That is, the overall length of a board includes nose and tail lengths, and has limited influence on how the board will function in certain conditions, such as on a flat and relatively hard-packed surface. For example, most snowboards include an upturned nose and tail that do not contact the snow when riding on a flat slope. As a result, the nose and tail have little or no affect on the board's performance in such conditions. Instead, it is largely the portion of the board that actually contacts the snow or other surface that defines how the board rides on a flat surface. Since the board's overall length includes nose and tail lengths, which can vary widely from board to board, the overall length of a board cannot tell one what the effective edge length of the board actually is. Thus, a teaching to construct a board to have a particular overall length, or a particular overall length to waist width ratio, does not necessarily indicate anything regarding what the effective edge length relative to the waist width should be for the board.

In one embodiment of a board having an effective edge length to waist width ratio of 3.8 to about 4.35, and a waist width of at least about 245 mm to 250 mm or greater, rocker in the running length, and a distance between the forward reference stance position 9*a* and a forward transition line 21 and/or a distance between the rear reference stance position 10*a* and a rear transition line 31 is between about 150 and about 350 mm. This embodiment may include a snowboard with a forward binding mounted nearer the nose of the board than a rear binding, which is mounted nearer the tail of the board. The forward and rear bindings may be spaced apart from each other, e.g., 300-600 mm apart.

In another aspect of the invention, the board may have a core with a thickness that is greater than about 5 mm within about 100 mm of a forward transition line and/or a thickness that is greater than about 5 mm within about 100 mm of a rear transition line. In particular, this is in contrast to prior snowboards, in which the core thins to less than 5 mm at larger distances from the transition lines, e.g., the core of such boards typically has a thickness of less than 5 mm within about 150 mm or more of the transition lines. By having a relatively thick board core nearer the transition lines 21, 31, the board 1 may be made more responsive to rider input. For example, a relatively thicker board core near the transition lines 21, 31, the board 1 may allow a rider to ollie or otherwise bend the board and recover the stored energy from the board in much less time than prior boards permit. This feature allows a rider to approach much closer to an obstacle, such as a rail, box or other feature raised above the gliding surface, before initiating an ollie or similar maneuver. The rider may also be capable of higher ollies, e.g., jumping up off of a gliding surface, than were previously possible with other boards. The core length feature of this illustrative embodiment may be used with, or without, a rocker configuration in the running length and/or other aspects of the invention.

FIG. 1 shows an illustrative embodiment of a core 12 that extends along part or all of the running length 4 of the board 1. That is, the core 12 may extend to, and beyond, the transition lines 21, 31, or may end prior to the transition lines 21, 31. The core may be made of wood, e.g., using strips of laminated wood of one or more types, such as alder, balsa, and/or others. The core 12 may then be laminated with top and bottom reinforcement layers, top and bottom sheets that provide the top and bottom surfaces 5, 6, polymer sidewall elements, metal edges, and other components commonly used in the manufacture of snowboards having a sidewall-type construction. Of course, the core 12 may be made of other materials, such as a composite honeycomb material, a foam, metal, and/or other materials or combinations of materials. In cap construction-type boards, the core 12 thickness may be defined during the molding process of the board, e.g., a foam material may expand or otherwise take on a shape and thickness that is defined by a mold cavity in which the board 1 is made. Thus, thickness variations of a board 1 may be achieved by adjusting the thickness of the core 12 of the board.

Although the core 12 may be relatively thick near the transition lines 21, 31, the core 12 may thin, e.g., to 2 mm or less, in regions even closer to the transition lines 21, 31. For example, within about 0-80 mm of the transition lines 21, 31, the core may have a thickness of less than 5 mm, such as a thickness of about 0 mm-2 mm. In one embodiment, the core 12 may have a thickness that is greater than 5 mm within about 85 mm of the forward and rear transition lines, and may have a thickness that reduces to about 2 mm or less at the transition lines 21, 31. In some embodiments, the core 12 may have an approximately constant thickness of greater than 5 mm along substantially the entire running length 4 of the board 1. However, within about 80-120 mm of the effective edge points, the core 12 may abruptly thin from a thickness greater than about 5 mm such that the core 12 has a thickness of about 2 mm or less within about 30 mm of one or both of the transition lines 21, 31.

In another aspect of the invention, the side edges on opposite sides of the running length may each include a curved, concave sidecut portion at the waist, curved, convex transition zones at the forward and rear effective edge points and a straight section adjacent each transition zone. For example, FIG. 2 shows an embodiment in which the side edges 7 include a central, curved sidecut portion 72, curved, convex transition zones 73 at each of the effective edge points 71, and a straight section 74 adjacent each transition zone 73. The sidecut portions 72 may have any suitable radius of curvature, or multiple radii of curvature in a compound curve, such as 5 meters or more. Alternately, the sidecut portions 72 may include a plurality of relatively short straight sections that together form an overall curved sidecut portion 72. The sidecut portion 72 may also include a bulge near the waist 11, e.g., a relatively small convex portion near the waist 11, yet still have an overall concave curve arrangement. Thus, the sidecut portions 72 need not have a continuously curved concave arrangement, but rather have a set of features that together form an overall curved, concave edge portion. The transition zones 73 may also have any suitable radius, or radii, of curvature, although the radius of curvature will generally be larger than that for the sidecut portions 72. In one embodiment, the transition zones 73 may have a radius of curvature of about 1500 meters or more.

Each of the straight sections 74 may extend between an inner end where the straight section 74 meets a respective curved sidecut portion 72 and an outer end where the straight section 74 meets a respective transition zone 73. In one embodiment, the straight sections 74 are tangent to the respective sidecut portion 72 at the inner end and tangent to the respective transition zone 73 at the outer end. This arrangement has been found to provide unexpected advantages in snowboard handling, e.g., when initiating a turn and/or riding flat. For example, the straight sections 74 may provide good, positive edge grip in turns, while the tangent configuration at both ends of the straight sections 74 allow for a more gradual engagement of the straight section with the snow or other gliding surface than would otherwise be possible. Although other snowboards have included straight sections at various locations in the running length and/or at the transition to the nose or tail, these boards did not have the straight sections arranged so as to be tangent to curved board portions at inner and outer ends of the straight sections. As a result, these boards may have had more unpredictable and/or abrupt engagement of the straight sections with the snow during turning. As with other aspects of the invention, this aspect may be used in combination with other features of the illustrative embodiments (such as a rocker configuration, a specific effective edge length to waist width ratio, etc.), or used alone.

In some embodiments, the straight sections 74 may be relatively close to the effective edge points 71. For example, the transition zones 73 may be located at each effective edge point 71 of the board 1, e.g., the transition zones 73 may be centered about a respective effective edge point 71. In one embodiment, the transition zones 73 may each have a length of about 20-150 mm and be centered on a respective effective edge point 71. The straight sections 74 may therefore be located within about 10-75 mm of a nearest effective edge point, and may each have a length of about 20-150 mm. In one illustrative embodiment that has been found particularly effective, the transition zones 73 may have a length of about 105 mm, and the straight sections 74 may have a length of about 35 mm. Also, the straight sections may form a relatively small angle with respect to a longitudinal axis of the board, i.e., the straight sections 74 may be nearly parallel to the longitudinal axis so as to form an angle of up to a few degrees relative to the longitudinal axis.

In another aspect of the invention, the core may have a thickness that begins to reduce from greater than about 5 mm at or near the inner ends of straight segments located adjacent transition zones to the nose and/or tail. For example, the board 1 in FIGS. 1 and 2 may have the core 12 arranged so that the core 12 has a thickness of about 5 mm or more, and begins to reduce in thickness, at or near the inner ends of the straight segments 74. The thickness of the core 12 may be reduced to less than about 2 mm near or at the forward or rear transition lines 21, 31. This type of arrangement in which the board's core 12 thins significantly from greater than 5 mm to about 2 mm or less in an area of the board 1 where the side edges 7 include straight sections 74 has been found to provide significant advantages in board handling. For example, by reducing the board's overall thickness in the areas where the straight sections 74 of the side edges 7 are located, the board 1 may be made more flexible in the local area at the extreme ends of the running length 4 where the straight sections 74 engage the snow or other surface when a turn is initiated. This may make the board 1 more forgiving at turn initiation, e.g., reduce the likelihood of the straight sections 74 catching the snow or otherwise establishing a more effective engagement with the gliding surface than is desired. This feature may be advantageous in a snowboard, in part because straight sections 74 of an edge 7 may tend to engage snow more aggressively and/or abruptly than a curved section would. As a result, the core 12 may be made relatively thick over a substantial portion of the running length 4 to make the board 1 more responsive to rider input, but also be thinned near the forward and/or rear transition lines 21, 31 and straight sections 74 to make the board perform better, and more predictably, when initiating turns or running flat.

It should be appreciated, e.g., from the discussion above regarding the illustrative embodiment of FIGS. 1 and 2, that a board 1 may be arranged to include one or more aspects of the invention, and that aspects of the invention can be combined in any suitable way. For example, a board may include the aspect of an effective edge length to waist width ratio of 3.8 to 4.35 as well as straight sections near the transition zones that are tangent to the other side edge portions at both inner and outer ends of the straight sections. In another embodiment, a board may include a core that has a thickness of greater than about 5 mm at about 100 mm from the forward and rear transitions together with an effective edge length to waist width ratio of 3.8 to 4.35. Other combinations are possible, as will be appreciated by those of skill in the art. For example, the board may have a bottom surface with an overall rocker configuration, e.g., such that the transition lines 21, 31 are raised above a flat, horizontal surface on which the board 1 is rested in an unweighted condition (i.e., no weight is applied to any portion of the board 1 other than the weight of the board itself). The rocker configuration may be arranged with a continuous curve along the entire running length 4, a convex center section (a rocker section) may be flanked by concave sections (forward and rear camber sections) in the running length 4, a convex center section (a rocker section) may be flanked by flat, planar sections in the running length, a flat center section may be flanked by convex sections (rocker sections), and so on. Alternately, in some embodiments, the board 1 may have a standard camber in the running length 4, a pair of camber sections in the running length 4, a flat section along the running length 4, and others. In short, the board may have a variety of different shapes or other configurations while incorporating one or more aspects of the invention.

Having thus described several aspects of the invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

The invention claimed is:

1. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

side edges on opposite sides of the running length and extending between the nose and the tail, the side edges defining forward effective edge points, a waist width and rear effective edge points; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting feature being located nearer the nose than the rear binding mounting feature, the forward binding mounting feature having a forward reference stance position nearest the nose and the rear binding mounting feature having a rear reference stance position nearest the tail;

wherein the board has an effective edge length that is a distance from a forward effective edge point on one side of the board to a rear effective edge point on the same side of the board, wherein the running length has a rocker configuration; and wherein the board has an effective edge length to waist width ratio of about 3.8 to about 4.35, the waist width is at least about 250 mm or greater, and a distance between the forward reference stance position and a forward transition line extending between the forward effective edge points or a distance between the rear reference stance position and a rear transition line extending between the rear effective edge points is between about 150 and about 350 mm.

2. The board of claim 1, wherein the effective edge length is between about 900 to about 1150 mm.

3. The board of claim 1, wherein a reference stance width between the forward and rear reference stance positions is about 450 mm to 585 mm.

4. The board of claim 3, wherein the reference stance width is centered on board.

5. The board of claim 1, wherein the side edges include a transition zone located at each effective edge point.

6. The board of claim 5, wherein each transition zone is centered about the respective effective edge point.

7. The board of claim 5, wherein each transition zone has length of about 20-150 mm.

8. The board of claim 5, wherein each transition zone is curved.

9. The board of claim 5, wherein the side edges include a straight section adjacent each transition zone, and the straight sections are located on a side of the transition zone nearest the waist.

10. The board of claim 9, wherein each straight section has a length of about 20-150 mm.

11. The board of claim 9, wherein each straight section is tangent to a respective transition zone.

12. The board of claim 9, wherein the side edges include a sidecut portion between the straight sections on opposite sides of the board, and each straight section is tangent to a respective sidecut portion.

13. The board of claim 12, wherein the side edges each have a sidecut depth of about 13 mm to 17 mm.

14. The board of claim 1, further comprising a core extending along the running length between the top and bottom surfaces, wherein a thickness of the core is greater than 5 mm within about 100 mm of the forward transition line or within about 100 mm of the rear transition line.

15. The board of claim 14, wherein the core thickness reduces to about 2 mm or less at the forward or rear transition line.

16. The board of claim 1, further comprising a core extending along the running length between the top and bottom surfaces, wherein a thickness of the core is greater than 5 mm within about 85 mm of the forward transition line or within about 85 mm of the rear transition line.

17. The board of claim 1, wherein each binding mounting feature includes a plurality of threaded inserts fixed to the running length, or includes a channel fixed to the running length.

18. The board of claim 1, wherein the forward and rear binding mounting features are separated from each other.

19. The board of claim 1, wherein the side edges include metal edges arranged to engage the gliding surface during riding.

20. The board of claim 1, wherein the nose, tail and running length of the board have a sidewall construction, and wherein the side edges include a sidewall member between the top surface and the bottom surface.

21. The board of claim 1, further comprising a core that has an approximately constant thickness of greater than 5 mm along the running length between points that are within about 100 mm of the forward and rear transition lines.

22. The board of claim 1, wherein a central portion of the running length has a continuously curved rocker.

23. The board of claim 1, wherein the board is a snowboard.

24. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

side edges on opposite outer sides of the running length and extending between the nose and the tail, the side edges defining opposed forward effective edge points, a waist width and opposed rear effective edge points, the side edges including opposed curved sidecut portions at the waist and opposed curved transition zones at the forward and rear effective edge points, the side edges also including a straight section of the side edge adjacent each transition zone, each straight section extending between an inner end of the straight section at a respective curved sidecut portion and an outer end of the straight section at a respective curved transition zone, each straight section of the side edges being tangent at the inner end to the respective curved sidecut portion and being tangent at the outer end to the respective curved transition zone; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting feature being located nearer the nose than the rear binding mounting feature, the forward binding mounting feature having a forward reference stance position nearest the nose and the rear binding mounting feature having a rear reference stance position nearest the tail.

25. The board of claim 24, wherein the board has an effective edge length that is a distance from a forward effective edge point on one side of the board to a rear effective edge point on the same side of the board, and wherein the board has an effective edge length to waist width ratio of about 3.8 to about 4.35.

26. The board of claim 24, wherein the straight sections have a length of about 20 to 150 mm.

27. The board of claim 24, wherein the transition zones have a length of about 20 to 150 mm.

28. The board of claim 24, wherein an effective edge length of the board is between about 900 to about 1150 mm.

29. The board of claim 24, wherein a reference stance width between the forward and rear reference stance positions is about 450 mm to 585 mm.

30. The board of claim 24, wherein the sidecut portions include a convex bulge near a longitudinal center of the board.

31. The board of claim 24, wherein each transition zone is centered about the respective effective edge point.

32. The board of claim 24, wherein the side edges each have a sidecut depth of about 13 mm to 17 mm.

33. The board of claim 24, further comprising a core extending along the running length between the top and bottom surfaces, wherein a thickness of the core is greater than 5 mm within about 100 mm of a forward transition line or within about 100 mm of a rear transition line.

34. The board of claim 33, wherein the core thickness reduces to about 2 mm or less at the forward or rear transition line.

35. The board of claim 24, further comprising a core extending along the running length between the top and bottom surfaces, wherein a thickness of the core is greater than 5 mm within about 85 mm of a forward transition line or within about 85 mm of a rear transition line.

36. The board of claim 24, wherein each binding mounting feature includes a plurality of threaded inserts fixed to the running length, or includes a channel fixed to the running length.

37. The board of claim 24, wherein the forward and rear binding mounting features are separated from each other.

38. The board of claim 24, wherein the side edges include metal edges arranged to engage the gliding surface during riding.

39. The board of claim 24, wherein the nose, tail and running length of the board have a sidewall construction, and wherein the side edges include a sidewall member between the top surface and the bottom surface.

40. The board of claim 24, wherein the nose, tail and running length of the board have a cap construction.

41. The board of claim 24, wherein a central portion of the running length has rocker.

42. The board of claim 24, wherein the board is a snowboard.

43. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

a core extending along the running length and between the top and bottom surfaces;

side edges on opposite sides of the running length and extending between the nose and the tail, the side edges defining forward effective edge points, a waist width and rear effective edge points; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting feature being located nearer the nose than the rear binding mounting feature, the forward binding mounting feature having a forward reference stance position nearest the nose and the rear binding mounting feature having a rear reference stance position nearest the tail;

wherein the core has a thickness that is greater than 5 mm within about 100 mm of a forward transition line extending between the forward effective edge points or a thickness that is greater than 5 mm within about 100 mm of a rear transition line extending between the rear effective edge points, and wherein the core has a thickness that is less than 5 mm within about 30 mm of a forward transition line extending between the forward effective edge points or a thickness that is less than 5 mm within about 30 mm of a rear transition line extending between the rear effective edge points.

44. The board of claim 43, wherein the core thickness is greater than 5 mm within about 90 mm of the forward or rear transition line.

45. The board of claim 43, wherein the core thickness is greater than 5 mm within about 80 mm of the forward or rear transition line.

46. The board of claim 43, wherein the core thickness is less than 5 mm within about 60 mm of the forward or rear transition line.

47. The board of claim 43, wherein the core thickness reduces to about 2 mm or less at the forward or rear transition line.

48. The board of claim 43, wherein the core thickness is greater than 5 mm within about 100 mm of both the forward and rear transition line.

49. The board of claim 43, wherein an effective edge length of the board is between about 900 to about 1150 mm.

50. The board of claim 43, wherein a reference stance width between the forward and rear reference stance positions is about 450 mm to 585 mm

51. The board of claim 50, wherein the reference stance width is centered on board.

52. The board of claim 43, wherein the side edges include a transition zone located at each effective edge point.

53. The board of claim 52, wherein each transition zone is centered about a respective effective edge point.

54. The board of claim 52, wherein each transition zone has length of about 20-150 mm.

55. The board of claim 52, wherein each transition zone is curved.

56. The board of claim 52, wherein the side edges include a straight section adjacent each transition zone, and the straight sections are located on a side of the transition zone nearest the waist.

57. The board of claim 56, wherein each straight section has a length of about 20-150 mm.

58. The board of claim 56, wherein each straight section is tangent to a respective transition zone.

59. The board of claim 56, wherein the side edges include a sidecut portion between the straight sections on opposite sides of the board, and each straight section is tangent to a respective sidecut portion.

60. The board of claim 43, wherein the side edges each have a sidecut depth of about 13 mm to 17 mm.

61. The board of claim 43, wherein each binding mounting feature includes a plurality of threaded inserts fixed to the running length, or includes a channel fixed to the running length.

62. The board of claim 43, wherein the forward and rear binding mounting features are separated from each other.

63. The board of claim 43, wherein the side edges include metal edges arranged to engage the gliding surface during riding.

64. The board of claim 43, wherein the nose, tail and running length of the board have a sidewall construction, and wherein the side edges include a sidewall member between the top surface and the bottom surface.

65. The board of claim 43, wherein the nose, tail and running length of the board have a cap construction.

66. The board of claim 43, wherein a central portion of the running length has rocker.

67. The board of claim 43, wherein the board is a snowboard.

68. The board of claim 43, wherein the board has an effective edge length that is a distance from a forward effective edge point on one side of the board to a rear effective edge point on the same side of the board, and wherein the board has an effective edge length to waist width ratio of about 3.8 to about 4.35.

69. A gliding board comprising:

an upturned nose at a forward end of the board;

a tail at a rear end of the board;

a running length connected to and located between the nose and tail;

a top surface of the board extending from the nose to the tail over a top portion of the running length;

a bottom surface of the board extending from the nose to the tail over a lower portion of the running length, at least a portion of the bottom surface being constructed and arranged to contact a gliding surface during riding;

a core extending along the running length and between the top and bottom surfaces;

side edges on opposite sides of the running length and extending between the nose and the tail, the side edges defining opposed forward effective edge points, a waist width and opposed rear effective edge points, the side edges including a straight section in the running length between the waist and the forward effective edge points or between the waist and the rear effective edge points, the straight section having an inner end nearest the waist and an outer end nearest the forward or rear effective edge points; and forward and rear binding mounting features each arranged to engage with and secure a foot binding to the board top surface, the forward and rear binding mounting features each defining a respective forward and rear binding mounting region in the running length in which a respective foot binding is securable to the board, the forward binding mounting feature being located nearer the nose than the rear binding mounting feature, the forward binding mounting feature having a forward reference stance position nearest the nose and the rear binding mounting feature having a rear reference stance position nearest the tail;

wherein the core has an constant thickness from the waist to the inner end of the straight section, and the core reduces in thickness from near the inner end in a direction toward the nose or tail to a thickness of less than about 2 mm near the forward or rear effective edge point.

70. The board of claim 69, wherein the core has an constant thickness that is greater than 5 mm from the waist to the inner end of the straight section, and the core reduces in thickness from near the inner end to about 2 mm or less in a direction toward nose or tail.

71. The board of claim 69, wherein the core has a thickness that is greater than about 5 mm within about 100 mm of a forward transition line extending between the forward effective edge points or a thickness that is greater than about 5 mm within about 100 mm of a rear transition line extending between the rear effective edge points.

* * * * *